US009234255B2

(12) United States Patent
Celotto

(10) Patent No.: US 9,234,255 B2
(45) Date of Patent: Jan. 12, 2016

(54) PROCESS FOR THE HEAT TREATMENT OF METAL STRIP MATERIAL

(75) Inventor: Steven Celotto, Heiloo (NL)

(73) Assignee: TATA STEEL NEDERLAND TECHNOLOGY BV, Ijmuiden (NL)

( * ) Notice: Subject to any disclaimer, the term of this patent is extended or adjusted under 35 U.S.C. 154(b) by 138 days.

(21) Appl. No.: 13/575,507

(22) PCT Filed: Jan. 25, 2011

(86) PCT No.: PCT/EP2011/000303
§ 371 (c)(1),
(2), (4) Date: Jul. 26, 2012

(87) PCT Pub. No.: WO2011/091983
PCT Pub. Date: Aug. 4, 2011

(65) Prior Publication Data

US 2012/0291928 A1 Nov. 22, 2012

(30) Foreign Application Priority Data

Jan. 29, 2010 (EP) ..... 10000913

(51) Int. Cl.
*C21D 9/52* (2006.01)
*C21D 6/00* (2006.01)
*C22F 1/04* (2006.01)
(Continued)

(52) U.S. Cl.
CPC .. *C21D 9/52* (2013.01); *C21D 1/26* (2013.01); *C21D 6/005* (2013.01); *C21D 9/46* (2013.01); *C22C 38/04* (2013.01)

(58) Field of Classification Search
None
See application file for complete search history.

(56) References Cited

U.S. PATENT DOCUMENTS 3,320,085 A 5/1967 Turner
4,330,112 A 5/1982 Toshimitsu et al.
(Continued)

FOREIGN PATENT DOCUMENTS

DE 1160815 B 1/1964
DE 2952670 A1 7/1980
(Continued)

OTHER PUBLICATIONS

Machine-English translation of Korean patent publication 1020040095991, Chi-Sang Yoon, Nov. 16, 2004.*
(Continued)

*Primary Examiner* — Deborah Yee
(74) *Attorney, Agent, or Firm* — Novak Druce Connolly Bove + Quigg LLP

(57) ABSTRACT

Disclosed is a process for the heat treatment of metal strip material providing mechanical properties that differ over the width of the strip, wherein the strip is heated and cooled and optionally over-aged during a continuous annealing process. At least one of the following parameters in the process differs over the width of the strip: heating rate, top temperature, top temperature holding time, cooling trajectory after top temperature; or, when over-aging is performed, at least one of the following parameters in the process differs over the width of the strip: heating rate, top temperature, top temperature holding time, cooling trajectory after top temperature, over-aging temperature, over-aging temperature holding time, lowest cooling temperature before over-aging, re-heating rate to over-aging temperature. Also, at least one of the cooling trajectories follows a non-linear temperature-time path. Also disclosed is strip material thus produced.

14 Claims, 8 Drawing Sheets

(51) Int. Cl.

| | |
|---|---|
| ***C21D 1/26*** | (2006.01) |
| ***C21D 9/46*** | (2006.01) |
| ***C22C 38/04*** | (2006.01) |

(56) References Cited

U.S. PATENT DOCUMENTS

| | | | | |
|---|---|---|---|---|
| 4,527,506 | A | 7/1985 | Hoetzl | |
| 4,609,035 | A | 9/1986 | Haslett et al. | |
| 4,644,667 | A | 2/1987 | Yanagi et al. | |
| 4,820,358 | A | 4/1989 | Chang | |
| 5,238,510 | A | 8/1993 | Dutton et al. | |
| 5,547,524 | A | 8/1996 | Sainfort et al. | |
| 8,152,943 | B2 * | 4/2012 | ten Cate et al. | 148/559 |
| 2004/0112485 | A1 * | 6/2004 | Reinhold et al. | 148/639 |
| 2005/0217770 | A1 | 10/2005 | Lequeu et al. | |
| 2007/0259200 | A1 | 11/2007 | Lequeu et al. | |
| 2012/0097298 | A1 | 4/2012 | Sommer et al. | |
| 2012/0304448 | A1 | 12/2012 | Hartmann et al. | |

FOREIGN PATENT DOCUMENTS

| | | | | |
|---|---|---|---|---|
| DE | 102008063985 | A1 | | 7/2010 |
| DE | 102009015013 | B4 | | 5/2011 |
| DE | 102009052210 | B4 | | 8/2012 |
| DE | 102006054389 | B4 | | 8/2014 |
| EP | 0155753 | A1 | | 9/1985 |
| EP | 0284876 | A1 | | 10/1988 |
| JP | 58-052440 | | * | 3/1983 |
| JP | H03188226 | A | | 8/1991 |
| JP | H0813046 | A | | 1/1996 |
| JP | 2000-160258 | | * | 6/2000 |
| JP | 2001-011541 | | * | 1/2001 |
| JP | 2001011541 | A | | 1/2001 |
| JP | 2003213387 | A | | 7/2003 |
| JP | 2004035967 | A | | 2/2004 |
| JP | 2004059970 | A | | 2/2004 |
| JP | 2004115830 | A | | 4/2004 |
| JP | 2004314113 | A | | 11/2004 |
| WO | 2005098072 | A2 | | 10/2005 |
| WO | 2007080265 | A1 | | 7/2007 |

OTHER PUBLICATIONS

Machine-English translation of Japanese Patent No. 58-052440, Akisue Osamu et al., Mar. 28, 1983.*

Machine-English translation of JP 2001-011541, Minami Kenji et al. Jan. 16, 2001.*

International Search Report dated Aug. 22, 2011 from International Application PCT/EP2011/000303 (WO 2011/091983 A2).

Krieger, Markus et al., "Effect of alloy composition and processing on microstructure and properties of multiphase steels", Tagungsband zu MEFORM 2009, Mar. 2009, ISSN: 978 3 86012 363-8.

Pichler, A. et al., "High-strength hot-dip galvanized steel grades: a critical comparison of alloy design, line configuration and properties", Mechanical Working and Steel Processing Conference Proceedings, vol. 44, Sep. 2002, ISSN: 1-886362-62-9.

Pichler, A. et al., "Processing and properties of cold-rolled trip steels", 43rd Mechanical Working and Steel Processing Conference Proceedings, 2001, ISSN: 1-886362-56-4.

Toda, K. et al., "Properties of Cold-Rolled High-Strength Steel Sheets", Metallurgical Transactions A, 1976.

Pichler, Andreas et al., "Processing of thin sheet multiphase steel grades", Steel Research In., 2007.

Opposition against an European Patent No. EP2529038 by voestalpine Stahl GmbH, Sep. 30, 2014.

Opposition against an European Patent No. EP2529038 by ThyssenKrupp Steel Europe AG, Oct. 1, 2014.

The Making, Shaping and Treating of Steel, Tenth Edition, Section 7 Heat Treatment of Cold-Reduced Steel, Tenth Edition, p. 1110-1111 (1985).

Wikipedia, Annealing (metallurgy), URL: < http://en.wikipedia.org/wiki/Annealing_(metallurgy) >, retrieved from the Internet Jan. 2, 2015.

An Introduction to Iron and Steel Processing, JFE 21st Century Foundation, Chapter 3(C)(5) (2003), URL: < http://www.jfe-21st-cf.or.jp/chapter_3/3c_5.html >, retrieved from the Internet Jan. 2, 2015.

Encyclopdia Britannica, "annealing". Encyclopdia Britannica Online. Encyclopdia Britannica Inc., 2015, retrieved from the Internet Jan. 2, 2015, <http://www.britannica.com/EBchecked/topic/26292/annealing>.

Eurotherm by Schneider Electric discloses the following continuous annealing line, URL: < http://www.eurotherm.com/industries/heat-treatment/metals-applications/continuous-annealing-and-galvanizing-lines/ >, retrieved from the Internet Jan. 2, 2015.

The Making, Shaping and Treating of Steel, Continuous Annealing, Tenth Edition, p. 1116-1118 (1985).

Certified English Translation of paragraph [0018] prepared Oct. 2, 2015 of JP2001-011541 to Kenji Minami et al.

* cited by examiner

PROCESS FOR THE HEAT TREATMENT OF METAL STRIP MATERIAL

CROSS-REFERENCE TO RELATED APPLICATIONS

This application is a §371 National Stage Application of International Application No. PCT/EP2011/000303 filed on 25 Jan. 2011, claiming the priority of European Patent Application No. 10000913.3 filed on 29 Jan. 2010.

The invention relates to a process for the heat treatment of metal strip material providing mechanical properties that differ over the width of the strip. The invention also relates to strip material produced according to this process.

Usually steel strip material is subjected to a continuous annealing process after rolling, to provide the desired mechanical properties to the strip material. After annealing, the strip material can be coated, for instance by hot dip galvanising, and/or skin pass rolled to supply the desired surface properties to the strip material.

The annealing is performed by heating the strip at a certain heating rate, keeping the strip at a certain top temperature during a certain holding time, and cooling the strip at a certain cooling rate. For some purposes during the cooling of the strip the temperature is kept constant for a certain period of time to overage the strip. This conventional continuous annealing process provides mechanical properties for the strip which are constant over the length and width of the strip. Such a strip is cut into blanks, for instance for the automotive industry.

For certain purposes, mostly in the automotive industry, a blank is needed which has sections that have different mechanical properties. Such blanks are conventionally made by producing two or more strips having different mechanical properties, cutting blank parts from these strips and welding together the two or more blank parts having different mechanical properties to form one blank. It is also possible to weld the strips together and then cut blanks out of the combined strip. In this way a part for a body-in-white can be formed that, for instance, has mechanical properties at one end that are different from the mechanical properties at the other end.

However, these so-called tailor welded blanks have the drawback that the welds form a special zone due to the heating during welding, hereby deteriorating the blank for instance during a forming step of the blank.

The Japanese patent application JP2001011541A provides a method for providing a tailored steel strip for press forming in which the mechanical properties differ over the width of the strip. According to a first option, the mechanical properties are changed over the width of the strip by changing the cooling rate over the width of the strip when the steel strip leaves the continuous annealing furnace. The Japanese patent application as a second option mentions the changing of the mechanical properties over the width of the strip by adjusting the quantity of nitriding or carbonization over the width of the strip. A third option according to the Japanese patent application is the use of a steel strip having two or more sheet thicknesses over the width of the strip.

The options according to Japanese patent application JP2001011541A have some drawbacks. The third option is only possible when the thickness of the strip is symmetrical over the width of the strip. The second option using nitriding or carbonising is not suitable for the fast processing as is nowadays required in the steel industry. The first option provides only a limited variation in the mechanical properties in view of the example given in this document.

It is an object of the invention to provide a process for the heat treatment of strip material providing a variation in mechanical properties over the width of the strip that can be performed at economical velocities.

It is another object of the invention to provide a process for the heat treatment of strip material providing a variation in mechanical properties over the width of the strip that makes a wide variation in mechanical properties feasible.

It is a further object of the invention to provide a process for the heat treatment of strip material providing a variation in mechanical properties over the width of the strip wherein other treatment methods are use than provided in the state of the art.

It is also an object of the invention to provide strip material having mechanical properties that differ over the width of the strip One or more of the objects of the invention are reached with a process for the heat treatment of metal strip material providing mechanical properties that differ over the width of the strip, wherein the strip is heated and cooled and optionally over-aged during a continuous annealing process, characterised in that at least one of the following parameters in the process differs over the width of the strip:

heating rate
top temperature
top temperature holding time
cooling trajectory after top temperature or, when over-aging is performed, that at least one of the following parameters in the process differs over the width of the strip:

heating rate
top temperature
top temperature holding time
cooling trajectory after top temperature
over-aging temperature
over-aging temperature holding time
lowest cooling temperature before over-aging
re-heating rate to over-aging temperature and wherein at least one of the cooling trajectories after top temperature follows a non-linear temperature time path.

The inventors have found that each of the above parameters alone or in combination, when given a value that differs over the width of the strip, results in mechanical properties that differ over the strip as well. This invention thus provides a variety of processes to obtain strip material having mechanical properties that vary over the width of the strip, and the invention makes it possible to tailor the mechanical properties of the strip material over the width of the strip exactly to the wishes of the end-user of the strip that uses the tailored blanks, for instance the car manufacturer who uses such blanks to form parts for a body-in-white. With a non-linear temperature-time path is meant that the cooling rate is changed on purpose shortly after the start of the cooling trajectory, above 200° C.

According to a preferred embodiment the top temperature is different over two or more width zones of the strip, and optionally also the cooling trajectory after the top temperature holding time is different over these two or more width zones of the strip. The top temperature of the heat treatment has a strong influence on the mechanical properties of the strip and therefore is very suitable to provide different mechanical properties in different width zones of the strip. The cooling trajectory after the top temperature holding time can add to that, as elucidated above.

Preferably, the top temperature in at least one width zone is between the Ac1 temperature and the Ac3 temperature, and the top temperature in at least one other width zone is above Ac3 temperature. The use of these temperature ranges provides a strong variation in mechanical properties.

Alternatively, the top temperature in at least one width zone is below the Ac1 temperature, and the top temperature in at least one other width zone is between the Ac1 temperature and the Ac3 temperature. Whether this or the above preference is used of course depends on the type of metal and the purpose for which it will be used.

According to an alternative the top temperature in at least one width zone is above the Ac3 temperature, and the top temperature in at least one other width zone is below Ac1 temperature. For this alternative the same holds as above.

According to another alternative the top temperature in at least two width zones is between the Ac1 temperature and the Ac3 temperature, and there exists a temperature difference of at least 20° C. between the two top temperatures in these two width zones. Whether this alternative will be used or one of the above possibilities again depends on the type of steel used and the purpose for which the strip material will be used.

According to another preferred embodiment the cooling trajectories are different over two or more width zones of the strip and at least one of the cooling trajectories follows a non-linear temperature-time path. This means that for instance in one width zone the cooling rate changes from 5 to 40° C./s after a first cooling stretch, whereas another width zone is cooled at 40° C./s from the start.

According to a preferred embodiment an over-aging step is performed, the over-aging temperature being different over two or more width zones of the strip and/or the lowest cooling temperature before over-aging being different over these two or more widths of the strip. In this way the over-aging process step is used to vary the mechanical properties over the width zones of the metal strip. Often, the different over-aging temperatures are used in combination with different top temperatures.

According to this embodiment preferably the over-aging temperature holding time is between 10 and 1000 seconds, more preferably the over-aging temperature holding time being different over two or more width zones of the strip. This measure provides an accurate way to vary the mechanical properties over the width zones of the strip.

According to still another preferred embodiment the heating rate and/or the re-heating rate to over-aging temperature is different over two or more width zones of the strip. The heating rates provide a good way to vary the mechanical properties, often in combination with other parameters.

According to a special embodiment at least one of the parameters in the process varies gradually over at least part of the width of the strip. In this way also the mechanical properties vary gradually over the width of the strip, which can be very advantageous for the parts produced from blanks cut from such a strip. Such gradually varying properties cannot be provides by tailor welded blanks.

In most cases the strip is a steel strip, preferably a steel strip having a composition of a HSLA, DP or TRIP steel. However, the process according to the invention could also be used for aluminium strips.

According to a further preferred embodiment the at least one parameter that differs over the width of the strip is changed in value at least one moment in time during the processing of the strip. According to another preferred embodiment at least one other parameter is chosen to differ over the width of the strip at least one moment in time during the processing of the strip. In these ways the mechanical properties of the strip are also varied over the length of the strip, so in one strip two or more stretches are produced having different varying properties over the length of the strip. This can be advantageous when strip is produced that is many hundreds of meters long and only relatively small series of parts have to be produced.

The invention also relates to strip material having mechanical properties that differ over the width of the strip, produced according to the process as elucidated hereinabove.

The invention will be elucidated referring to four examples, of which the temperature-time cycles and the schematic zone distribution of the tailor annealed strips are shown in the accompanying drawings.

As a first example a tailor annealed strip is produced in which different width zones are heated to different top temperatures both above the Ac1 temperature.

Some components for the automotive industry require different amounts of formability that can adequately described in terms of total elongation. One way to achieve different amounts of total elongation is by making varying dual-phase microstructures with different volume fractions of martensite in a ferrite matrix. Increasing the volume fraction of martensite increases the strength and decreases the total elongation.

Figure 1A:
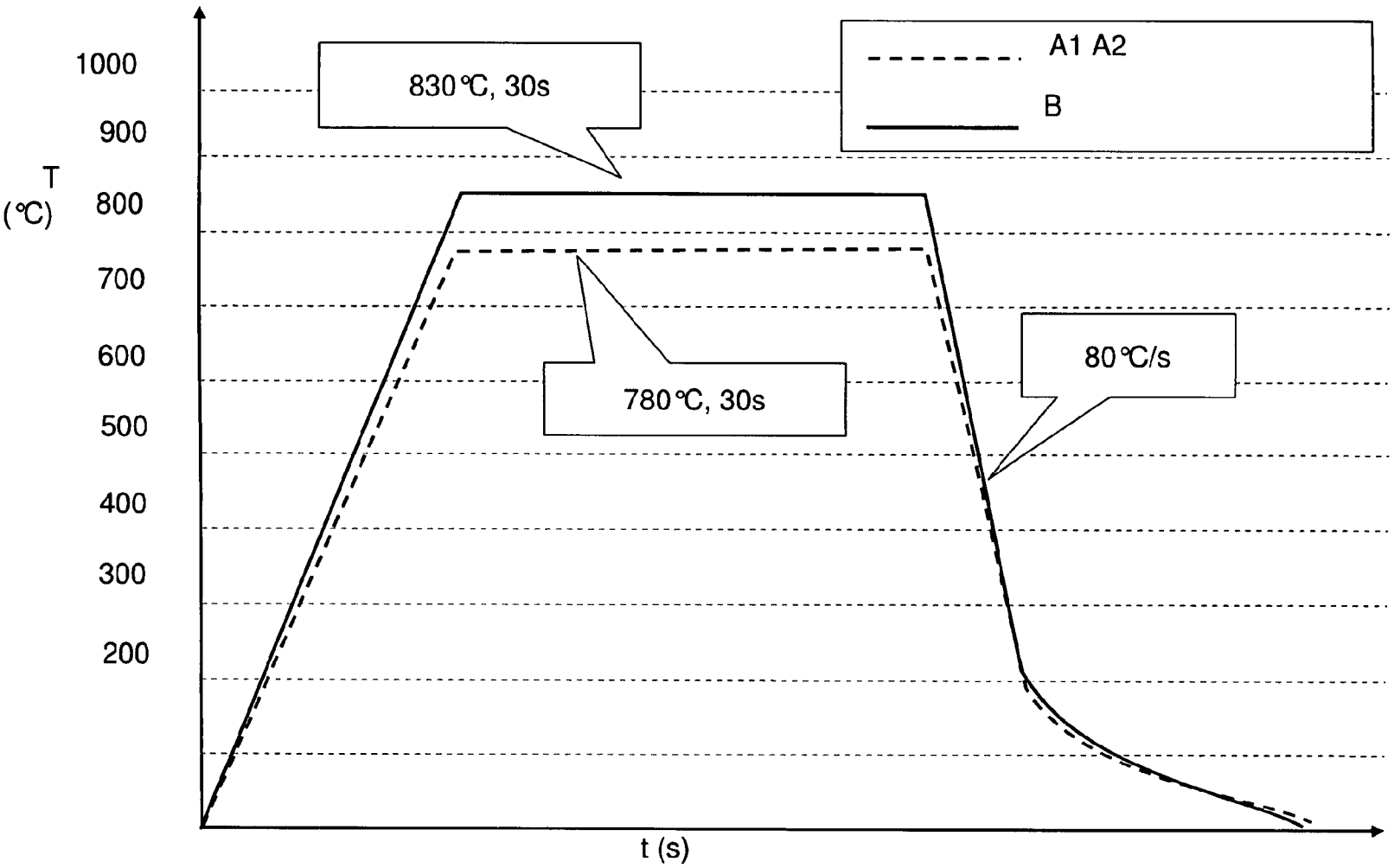
FIG. 1 shows an example of tailor annealing of steel strip using different top temperatures above Ac1 for different width zones of the strip.
Figure 1B:
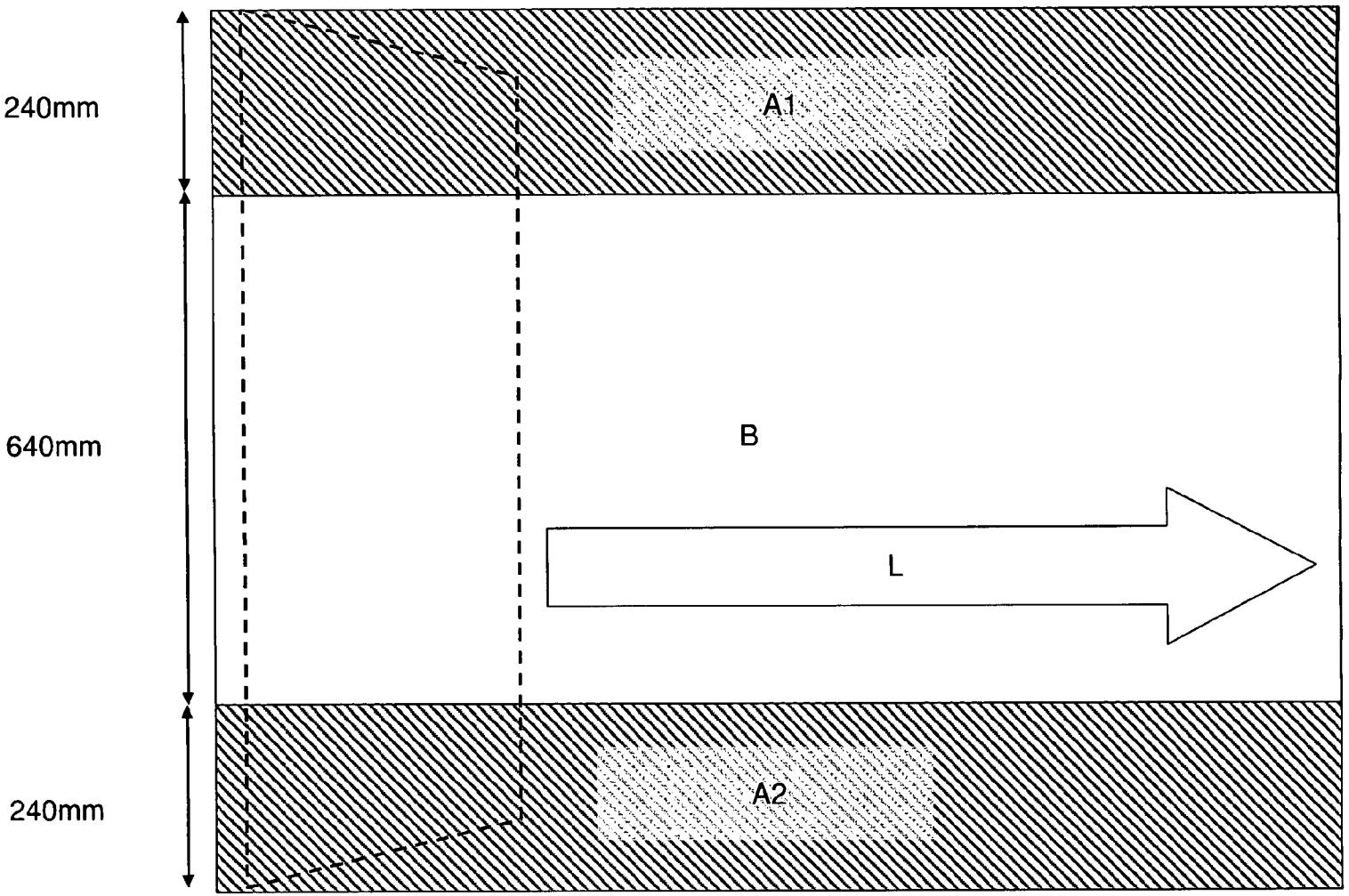

The different volume fractions of ferrite-martensite are made by heating up to different top temperatures as shown in FIG. 1*a*. The example shown in FIG. 1*b* is a steel strip that is tailor annealed for a roof-bow component in an automotive body-in-white. There are three zones (not including the transitional regions), where the two outer zones have the same temperature-time cycle and the middle zone is different. L denotes the length direction of the strip. The outer zones (A1 and A2) require higher ductility and are therefore heated to a top-temperature of about 780° C. for 30 seconds, while the centre region (B) is heated to a higher temperature of 830° C. for 30 seconds. The different top-temperatures result in different amount of austenite at the end of the temperature-time cycle. After the heating at the top temperatures, the whole strip is cooled with a rate of 30° C./s down to less than 200° C. and thereafter naturally cooled. The dash shape in FIG. 1*b* shows the form of a blank to be cut out from the strip, which will be used to form the component. The chemistry of the example material is given in Table 1 and the properties after the above processing are give in Table 2.

TABLE 1

| C wt % | Mn | Si | Cr |
|---|---|---|---|
| 0.09 | 1.8 wt % | 0.25 wt % | 0.5 wt % |

TABLE 2

| Zone | Annealing temperature (° C.) | Rp (MPa) | Rm (MPa) | Ag (%) | A80 (%) | Volume fraction martensite |
|---|---|---|---|---|---|---|
| A1 and A2 | 780 | 300 | 700 | 13 | 17 | 18% |
| B | 830 | 500 | 800 | 6 | 8 | 60% |

As a second example a tailor annealed strip is produced in which different width zones are heated to different top temperatures both above and below the Ac1 temperature.

The two extremes in strength-ductility properties that can be achieved in steel strip are recrystallised ferrite with high formability and fully martensitic with high strength and low ductility. Usually the ductility of martensite is too low for any significant formability. Instead of martensite, a fully bainitic microstructure which forms at slower cooling rates can be used, which has lower strength but more ductility. Such extremes may be useful to utilise the maximum ductility for a given material in certain regions of a component where high formability is required, while other regions have low ductility requirements and maximum strength is preferred.

Figure 2A:
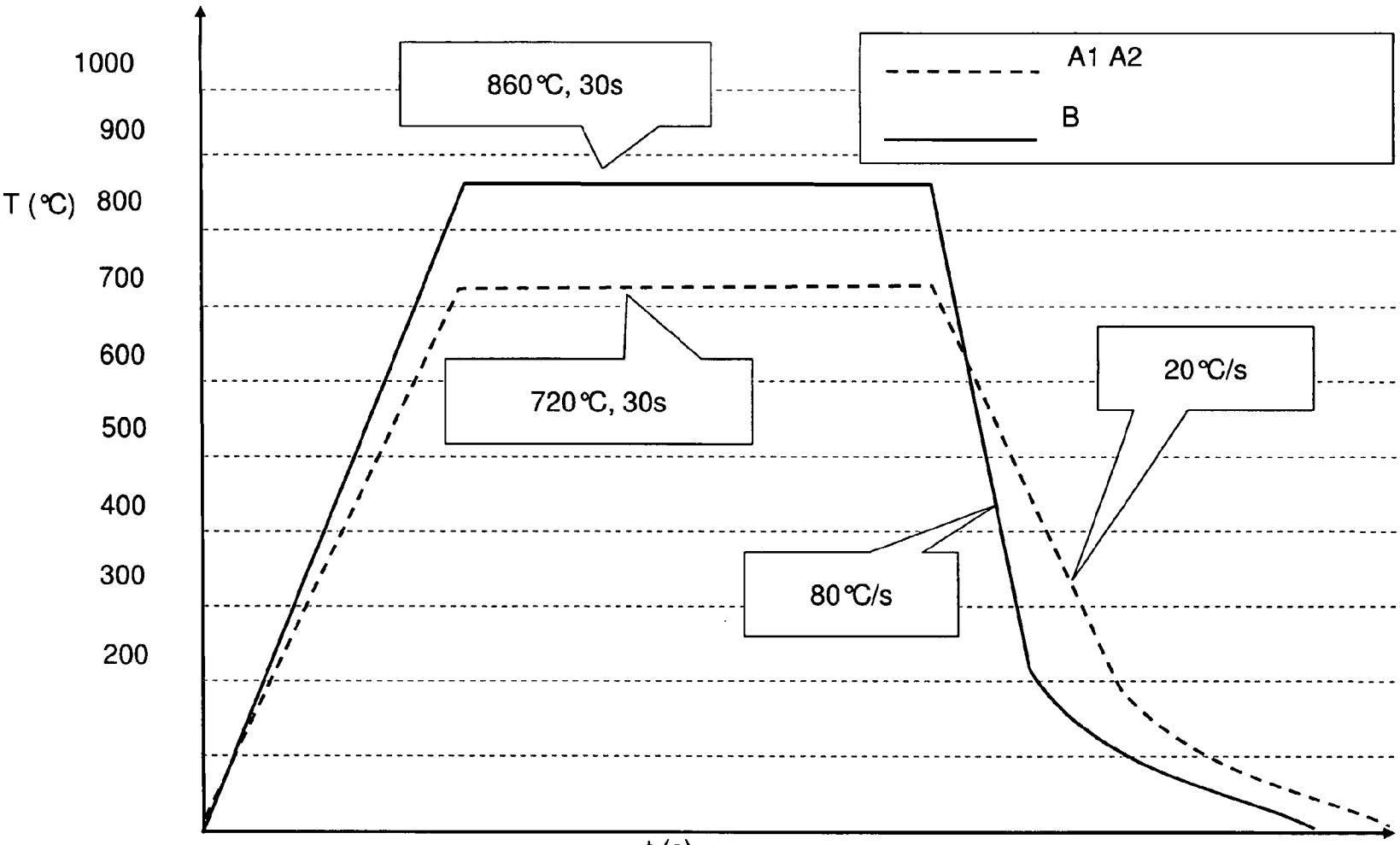
FIG. 2 show an example of tailor annealing of steel strip using different top temperatures, one below Ac1 and another above Ac1 for different width zones of the strip.
Figure 2B:
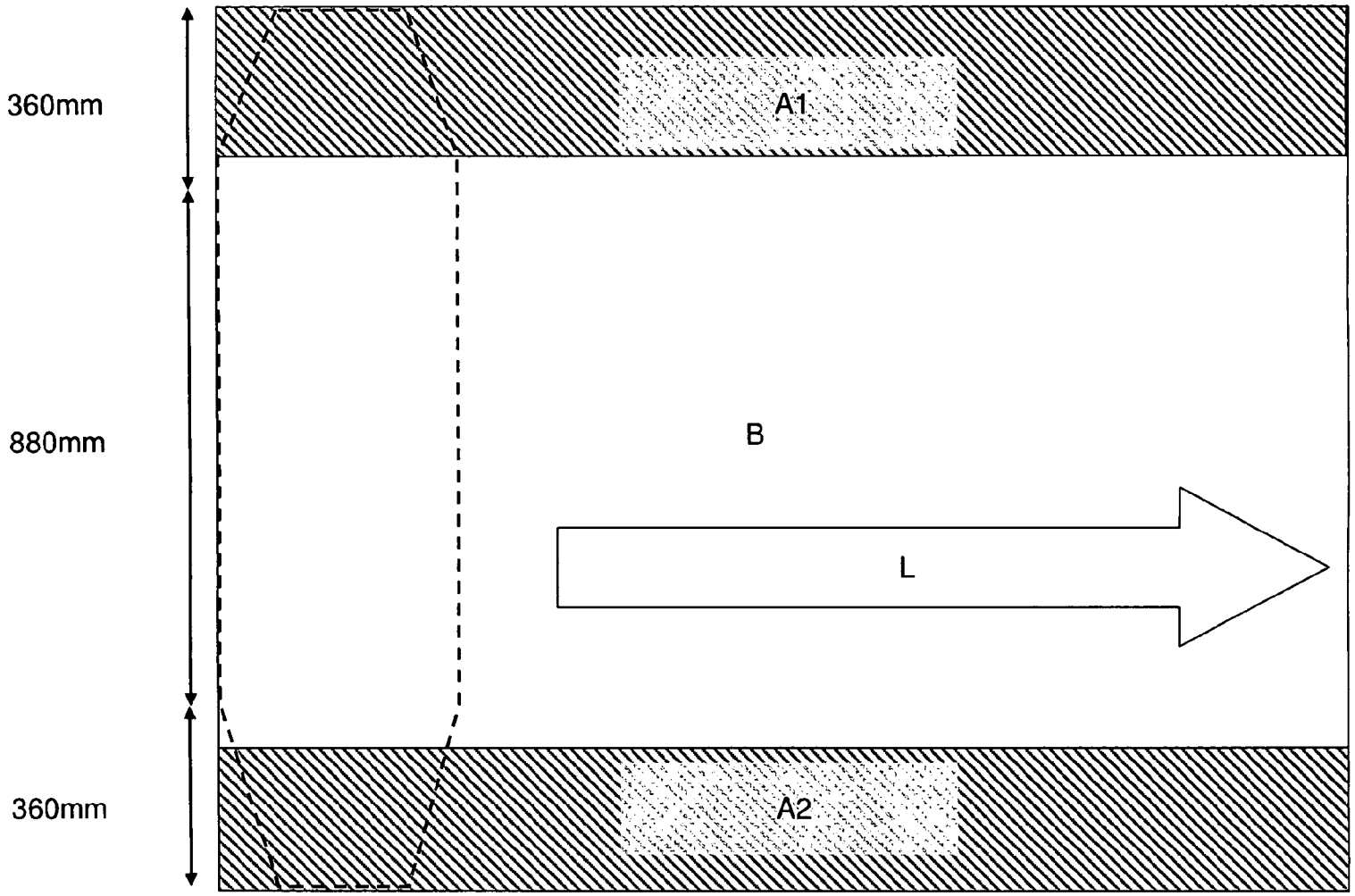

In the example shown in FIG. 2, tailor annealing using the principle of different top temperatures below and above Ac3 is used to manufacture steel strip optimised for a bumper-beam component. In the example shown in FIG. 2*b*, the strip is annealed with three different width zones where the two outer zones (A1 and A2) have the same temperature below Ac3 (720° C.) and the middle zone (B) is at a higher temperature (860° C., in this case greater than Ac3, see the temperature-time diagram of FIG. 2*a*. L denotes the length direction of the strip. The original condition of the strip is cold-rolled and during the annealing, the material in zones A1 and A2 recrystallises to become equiaxed ferrite with coarse carbides and pearlite. The cooling rate from this temperature is not critical but for convenience is 20° C./s. Zone B is heated to a higher temperature and in this case is above Ac3 so that it transforms entirely into austenite. This region is cooled at 80° C./s to form a wholly bainitic microstructure. The dash shape in FIG. 2*b* shows the form of a blank to be cut out from the strip, which will be used to form the component. The chemistry of example material is given in Table 3 and the properties after the above processing are give in Table 4.

TABLE 3

| C wt % | Mn | Si | Cr | Nb |
|---|---|---|---|---|
| 0.075 | 0.35 wt % | 0.02 wt % | 0.001 wt % | |

TABLE 4

| Zone | Annealing temperature (° C.) | Rp (MPa) | Rm (MPa) | Ag (%) | A80 (%) |
|---|---|---|---|---|---|
| A1 and A2 | 720 | 260 | 320 | 24 | 29 |
| B | 860 | 650 | 800 | 7 | 10 |

As a third example a tailor annealed strip is produced in which different width zones are cooled along a different cooling trajectory.

A multiple-path cooling trajectory can be used to accelerate the development of certain phases or microstructures that occur when a constant cooling rate is used. Slower cooling at higher temperatures increases the amount of ferrite formation for a given period compared to a cooling at a constant, faster rate. The following example uses this phenomenon and is an example of three different width zones within the strip. This example of tailor-annealed strip is optimised for an A-Pillar reinforcement component shown in FIG. 3*b*. The dash shape shows the form of a blank to be cut out from the strip, which will be used to form the component. L denotes the length direction of the strip.

Figure 3A:
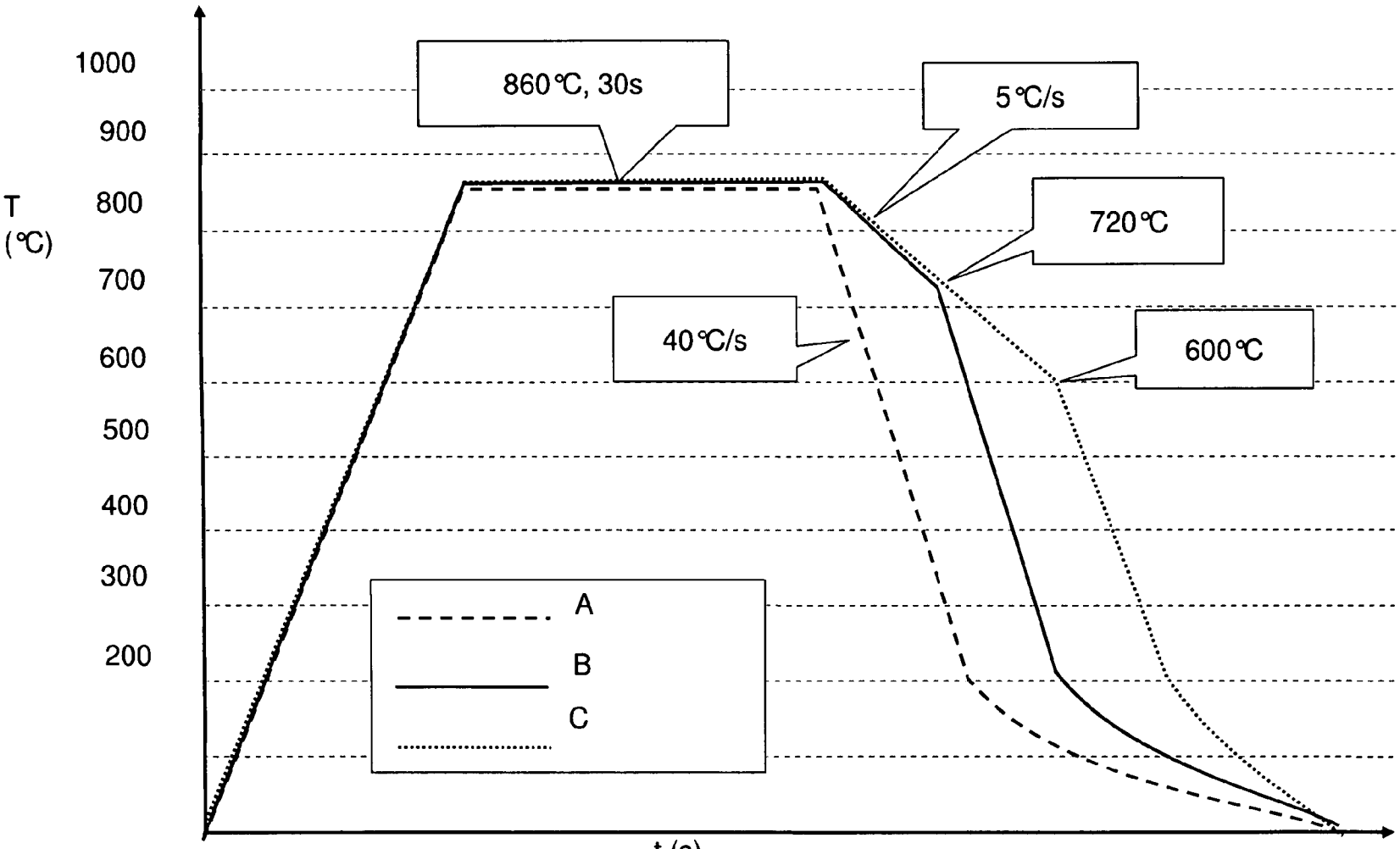
FIG. 3 shows an example of tailor annealing of steel strip using varying cooling rates for at least one of the width zones of the strip.
Figure 3B:
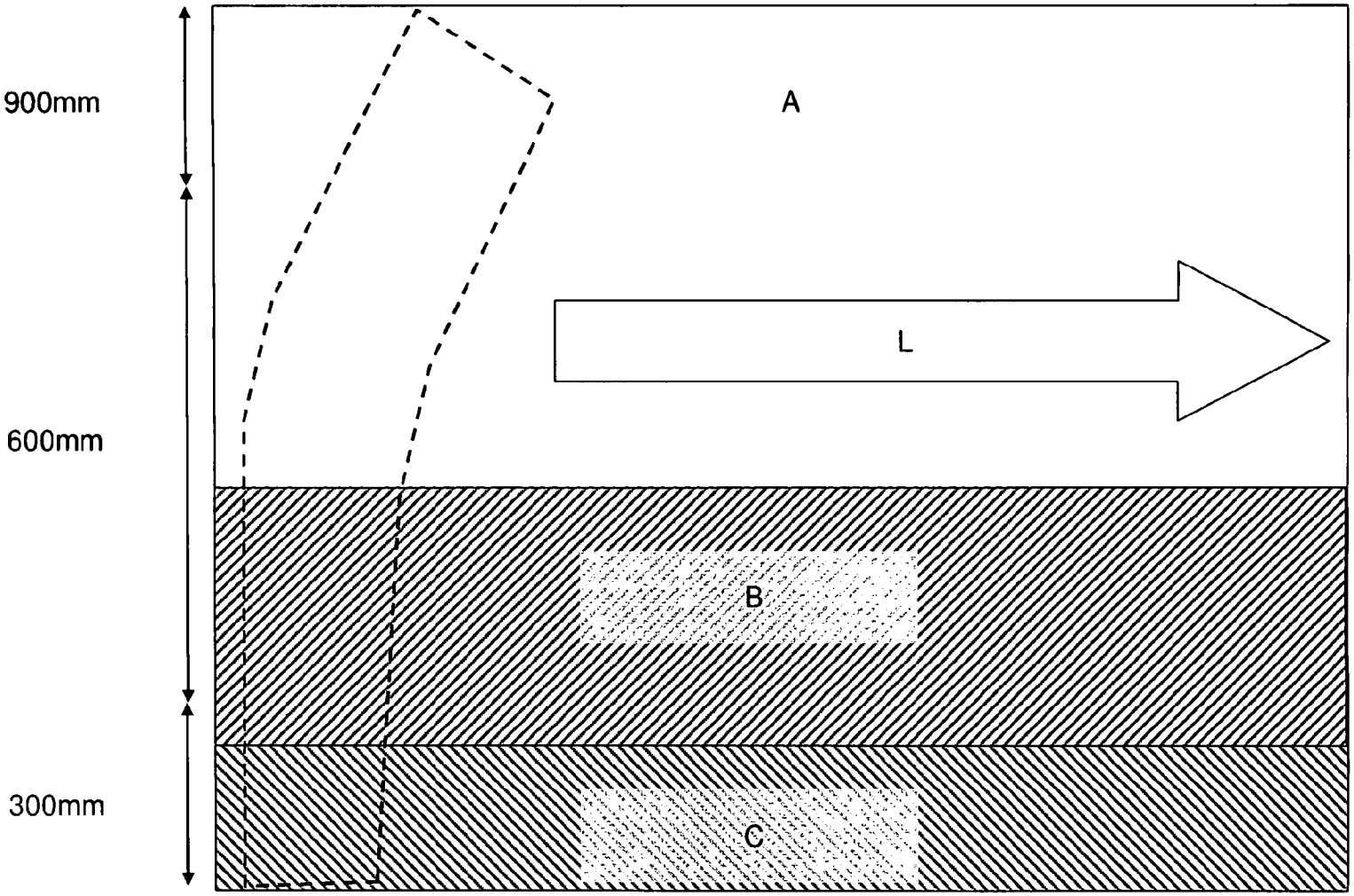

Three width zones are desired with increasing ductility requirements from A, B to C. First, the whole strip is heated by the same heating rate up to above Ac3 temperature, during a holding time long enough time to fully transform the steel strip into austenite. Zone A has the lowest ductility requirement that can be sufficiently met with a fully bainitic microstructure that forms when the steel is cooled at a rate of 40° C./second, showing a linear cooling trajectory above 200° C. in FIG. 3*a*. Zones B and C are both cooled at a relatively slow rate of about 5° C./s, but for different periods defined by the time when a particular temperature is reached, see the temperature-time diagram of FIG. 3*a* showing the non-linear cooling trajectories for zones B and C.

When zone B reaches 720° C. the cooling rate is increased to 40° C./s and similarly for zone C the cooling rate is increased to 40° C./s when it reaches 600° C. During the cooling at 5° C./s in zones B and C, the austenite is transforming into ferrite. When the cooling rate is increased, further transformation to ferrite is retarded and once the remaining austenite is cooled to a temperature below about 350° C. it transforms in martensite. Compared to zone B, zone C is held at higher temperatures for longer times due to the extended period with the slower cooling rate. This means more ferrite forms in zone C and thus zone C has greater formability. The chemistry of example material is given in Table 5 and the properties after the above processing are give in Table 6.

TABLE 5

| C | Mn | Si | Cr |
|---|---|---|---|
| 0.09 wt % | 1.8 wt % | 0.25 wt % | 0.5 wt % |

TABLE 6

| Zone | Rp (MPa) | Rm (MPa) | Ag (%) | A80 (%) |
|---|---|---|---|---|
| A | 650 | 800 | 7 | 10 |
| B | | 600 | | 24 |
| C | | 500 | | 28 |

As a fourth example a tailor annealed strip is produced in which different width zones are cooled using different intermediate hold or overage temperatures.

The formability requirements of some components are not optimally described in terms of total elongation alone, but are better described in conjunction with other criteria such as hole-expansion. Dual-phase microstructures deliver good strength-ductility, but ferrite-bainite mixtures deliver better hole-expansion than those with ferrite-martensite. The example shown in FIG. 4*b* is a solution for a rear longitudinal component in an automotive body-in-white. L denotes the length direction of the strip.

Figure 4A:
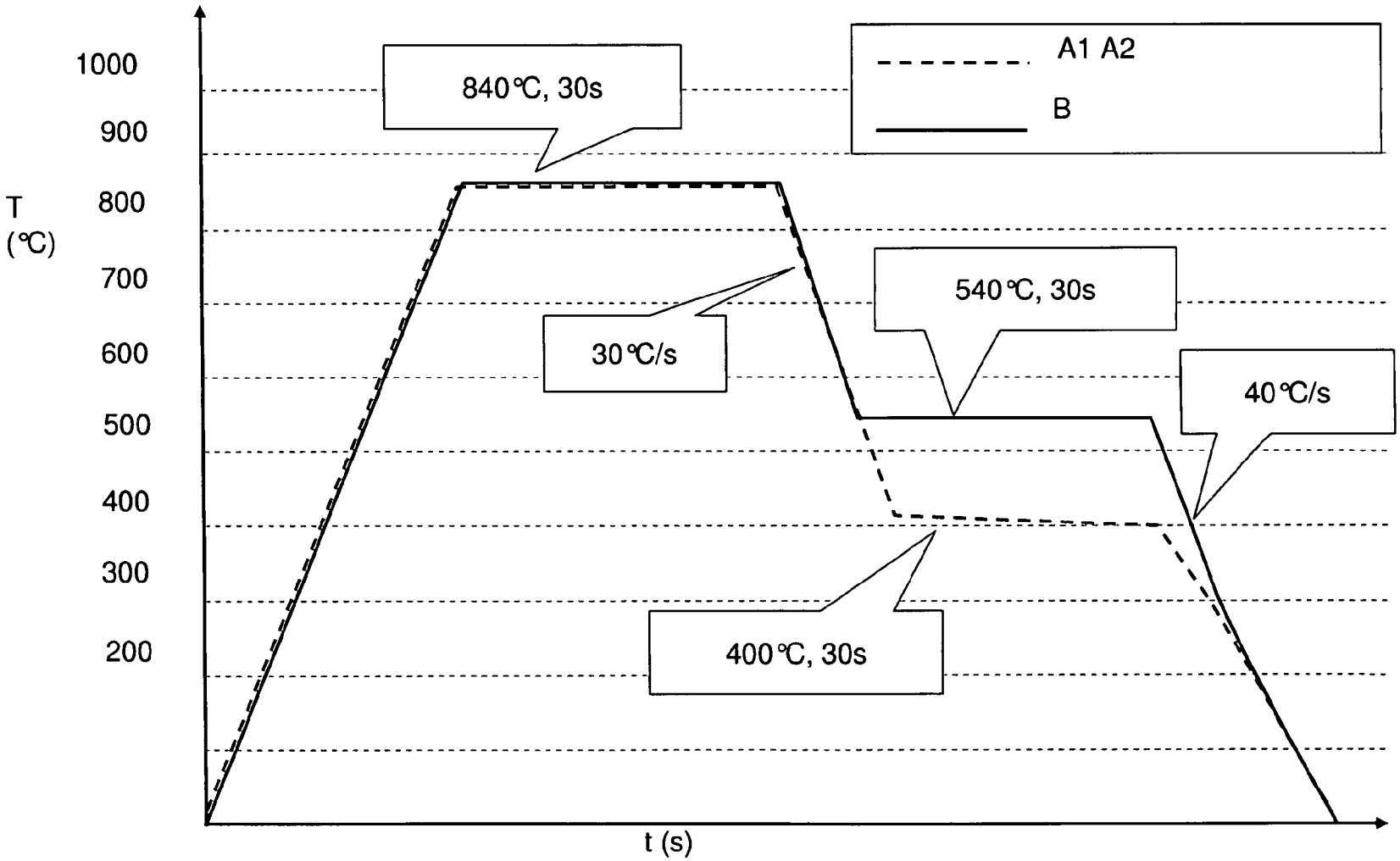
FIG. 4 shows an example of tailor annealing of steel strip using different intermediate hold or overage temperatures.
Figure 4B:
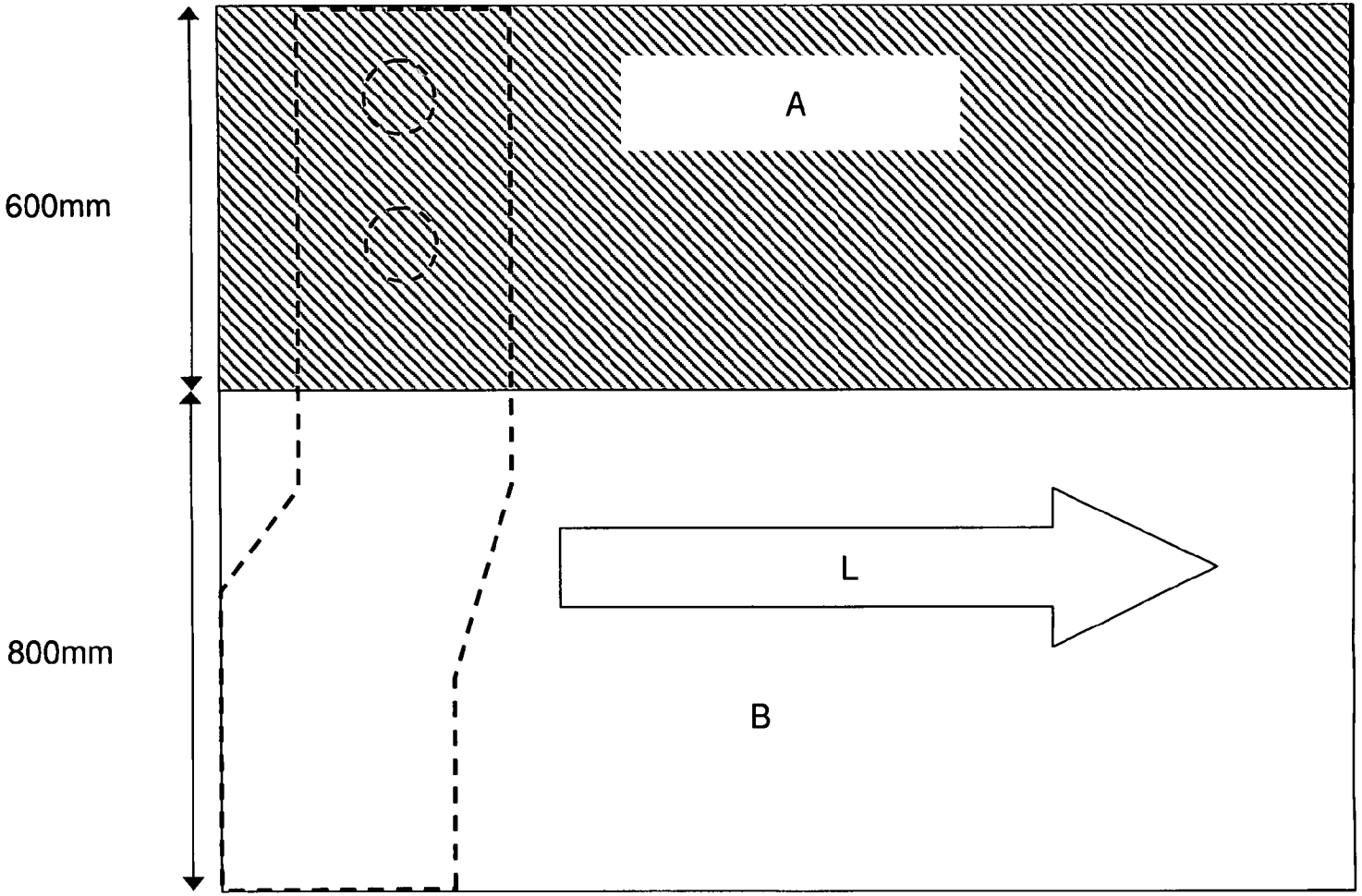

In this example, the whole strip is heated at the same heating rate and then held at the same top temperature of 840° C./s for the same holding time of 30 seconds until it totally transforms into austenite, see FIG. 4*a*. Thereafter the whole strip is uniformly cooled at the same cooling rate of 30° C./s until about 540° C. is reached. During this first cooling stage, ferrite re-grows to become the majority phase again. Upon reaching 540° C. the temperature of zone A is held for 30 seconds at this temperature, while zone B is cooled further down to 400° C. and then held at this temperature for about 30 seconds. After the intermediate annealing hold, the two zones are cooled to at least below 200° C. with a cooling rate of at least 20° C./s.

For the chemistry shown in Table 7, different proportions of bainite will form between the two different intermediate temperature used for zone A and B. For the higher intermediate holding temperature in zone A, the transformation kinetics of austenite to bainite are relatively slow and thus the final fraction consists mostly of ferrite and martensite with a relatively small fraction of bainite. In zone B with the lower intermediate holding temperature, the transformation kinetics of austenite to bainite are relatively fast and thus the final fraction consists mostly of ferrite and bainite with a relatively small fraction of martensite. The chemistry of example material is given in Table 7 and the properties after the above processing are give in Table 8.

TABLE 7

| C wt % | Mn wt % | Si wt % | Cr wt % | Nb wt % |
|---|---|---|---|---|
| 0.13 | 2.1 | 0.25 | 0.53 | 0.017 |

TABLE 8

| Zone | Rp (MPa) | Rm (MPa) | Ag (%) | A80 (%) | Hole-expansion coefficient |
|---|---|---|---|---|---|
| A | 700 | 1000 | 6 | 9 | 45 |
| B | 600 | 1020 | 8 | 11 | 25 |

It will be clear that in the above examples in the chemistries only the main elements are given. Of course inevitable impurities are present, but other elements can be present as well, the remainder being iron.

The invention claimed is:

1. A process for continuous annealing of a continuous steel strip providing mechanical properties that differ over two or more width zones defined over the width of the strip, said continuous annealing comprising:

heating the respective width zones of the strip to a respective top temperature, keeping the respective width zones of the strip at the respective top temperature for a respective top temperature holding time, and cooling the heated strip after the respective top temperature holding time, and over-aging the strip by keeping temperature of one or more of the width zones of the strip constant for a respective over-aging holding time during the cooling of the continuous annealing process, wherein over-ageing temperature is the same across the width of the strip and at least one of the following parameters in the process differs for said respective width zones over the width of the continuous strip to achieve the mechanical properties that differ over two or more width zones defined over the width of the strip:

over-aging temperature holding time lowest cooling temperature before over-aging re-heating rate to over-aging temperature.

2. Process according to claim 1, wherein the lowest cooling temperature before over-aging is different over these two or more widths of the strip.

3. Process according to claim 2, wherein the over-aging temperature holding time is between 10 and 1000 seconds.

4. Process according to claim 1, wherein the re-heating rate to over-aging temperature is different over two or more said width zones of the strip.

5. Process according to claim 1, wherein the strip is a steel strip having a composition of a HSLA, DP or TRIP steel.

6. Process according to claim 1, wherein the strip is hundreds of meters long, wherein the at least one parameter that differs over the width of the strip is changed in value at least one moment in time during the processing of the strip, to produce two or more stretches for respective series of parts, each stretch having different varying properties over the length of the strip.

7. The process according to claim 3, wherein the over-aging temperature holding time is different over two or more width zones of the strip.

8. A process for continuous annealing of a continuous aluminum alloy strip providing mechanical properties that differ over two or more width zones defined over the width of the strip, said continuous annealing comprising:

heating the respective width zones of the strip to a respective top temperature, keeping the respective width zones of the strip at the respective top temperature for a respective top temperature holding time, and cooling the heated strip after the respective top temperature holding time, and over-aging the strip by keeping temperature of one or more of the width zones of the strip constant for a respective over-aging holding time during the cooling of the continuous annealing process, wherein over-ageing temperature is the same across the width of the strip and at least one of the following parameters in the process differs for said respective width zones over the width of the continuous strip to achieve the mechanical properties that differ over two or more width zones defined over the width of the strip:

over-aging temperature holding time lowest cooling temperature before over-aging re-heating rate to over-aging temperature.

9. Process according to claim 8, wherein the strip is hundreds of meters long, wherein at least one other said parameter is chosen to differ over the width of the strip at least one moment in time during the processing of the strip, to produce two or more stretches for respective series of parts, each stretch having different varying properties over the length of the strip.

10. Process according to claim 1, wherein each of the two or more width zones is cooled from the respective top temperature directly to its respective over-aging temperature.

11. Process according to claim 2, wherein the strip is a steel strip having a composition of a HSLA, DP or TRIP steel.

12. Process according to claim 8, wherein the lowest cooling temperature before over-aging being different over these two or more widths of the strip, wherein the over-aging temperature holding time is between 10 and 1000 seconds.

13. Process according to claim 1, wherein the strip is hundreds of meters long.

14. The process according to claim 1, wherein the mechanical properties differ over only two width zones defined over the width of the strip.

* * * * *